US009353556B2

(12) United States Patent
Margheritti et al.

(10) Patent No.: US 9,353,556 B2
(45) Date of Patent: May 31, 2016

(54) ELECTRICAL VEHICLE LATCH

(71) Applicant: Magna Closures S.p.A., Leghorn (IT)

(72) Inventors: Enrico Margheritti, Lucca (IT); Francesco Cumbo, Pisa (IT)

(73) Assignee: MAGNA CLOSURES S.p.A., Leghorn (IT)

( * ) Notice: Subject to any disclaimer, the term of this patent is extended or adjusted under 35 U.S.C. 154(b) by 204 days.

(21) Appl. No.: 14/132,041

(22) Filed: Dec. 18, 2013

(65) Prior Publication Data

US 2014/0175813 A1 Jun. 26, 2014

(30) Foreign Application Priority Data

Dec. 21, 2012 (EP) ..... 12199307

(51) Int. Cl.

| | |
|---|---|
| ***E05C 3/06*** | (2006.01) |
| ***E05B 81/56*** | (2014.01) |
| ***E05B 81/06*** | (2014.01) |
| ***E05B 81/14*** | (2014.01) |
| ***E05B 85/02*** | (2014.01) |
| ***E05B 81/54*** | (2014.01) |
| *E05B 77/34* | (2014.01) |

(52) U.S. Cl.

CPC ..... *E05B 81/56* (2013.01); *E05B 81/06* (2013.01); *E05B 81/14* (2013.01); *E05B 81/54* (2013.01); *E05B 85/02* (2013.01); *E05B 77/34* (2013.01); *Y10T 292/1082* (2015.04)

(58) Field of Classification Search

USPC ..... 292/201, 216

See application file for complete search history.

(56) References Cited

U.S. PATENT DOCUMENTS

| | | | | |
|---|---|---|---|---|
| 6,232,684 | B1 * | 5/2001 | Haag | E05B 81/06 292/201 |
| 2005/0258652 | A1 * | 11/2005 | Usuzaki | E05B 17/042 292/216 |
| 2009/0243308 | A1 | 10/2009 | Ishiguro et al. | |
| 2010/0117379 | A1 * | 5/2010 | Mitchell | E05B 77/06 292/216 |

FOREIGN PATENT DOCUMENTS

| | | |
|---|---|---|
| EP | 1536090 A2 | 6/2005 |
| EP | 1811107 A2 | 7/2007 |

* cited by examiner

*Primary Examiner* — Mark Williams

(74) *Attorney, Agent, or Firm* — Dickinson Wright PLLC

(57) ABSTRACT

An electrical vehicle latch including a support assembly, a releasable closure mechanism carried by the support assembly and adapted to releasably engage a striker, an electrically-operated actuator assembly carried by the support assembly and which can be selectively activated to release the closure mechanism from the striker or to lock the closure mechanism in a condition of engagement with the striker, and an electrical control unit having a printed circuit board for controlling operation of the actuator assembly. The support assembly including a first support body carrying at least a ratchet of the closure mechanism in a position parallel to a first plane (P1), and a second support body carrying at least the printed circuit board in a position parallel to a second plane (P2) transvere to the first plane (P1).

14 Claims, 9 Drawing Sheets

ELECTRICAL VEHICLE LATCH

CROSS REFERENCE TO RELATED APPLICATIONS

This application claims the benefit and priority of European Application No. EP12199307.5 filed Dec. 21, 2012. The entire disclosure of the above application is incorporated herein by reference.

FIELD

The present invention relates to an electrical latch for a vehicle door, in particular of the type utilizing a double pawl arrangement.

BACKGROUND

This section provides background information related to the present disclosure which is not necessarily prior art.

As it is known, one of the defining characteristics of an electrical door latch is that it does not have mechanical linkages to outside and inside door handles. Instead, the door is released by an actuator in response to an electric signal coming from the handles.

Electrical door latches using double pawl arrangements normally comprise:

- a ratchet biased by a spring into a release position, wherein the ratchet is positioned to receive or release a striker fixed to a door post, and which can be moved to a partially locked or first-click position and a fully locked or second-click position, in which the striker is increasingly retained inside the ratchet and prevented from withdrawing;
- a primary pawl movable between a ratchet checking position, wherein the primary pawl is positioned to keep the ratchet in the partially locked or fully locked positions, and a ratchet release position, wherein the primary pawl permits the movement of the ratchet out of the partially locked or fully locked positions;
- an auxiliary ratchet operatively connected to the primary pawl and movable between an enabling position, in which the primary pawl is enabled to move to its ratchet checking position, and a disabling position, in which the auxiliary ratchet positions the primary pawl to its ratchet release position;
- a secondary pawl movable between an auxiliary ratchet holding position, in which the secondary pawl is positioned to hold the auxiliary ratchet in its enabling position, and an auxiliary ratchet release position, in which the secondary pawl is positioned to permit movement of the auxiliary ratchet to its disabling position;
- an electrically-operated actuator assembly which can be selectively activated for moving the secondary pawl to the auxiliary ratchet release position and the auxiliary ratchet to the enabling position; and
- an electrical control unit comprising a printed circuit board for controlling operation of the actuator assembly.

All the above-listed components are normally carried by a support body in turn secured to an edge of the vehicle door facing in use the door post carrying the striker; the latch is normally arranged in a door cavity also housing a window glass when lowered.

The double pawl arrangement consists in establishing a connection of a first set formed by the ratchet and the primary pawl with a second set formed by the auxiliary ratchet and the secondary pawl. The connection is configured such that only a portion of the forces experienced by the first set are applied to the second set, thus requiring only a relatively low effort to release the latch.

In conventional electrical latches, the support body normally carries the printed circuit board in a position parallel to the ratchet and to the edge of the door to which such latches are normally secured. The other mechanical components, such as the primary pawl, the auxiliary ratchet and the secondary pawl, are also carried in positions parallel to the ratchet and the printed circuit board.

Due to this kind of configuration, known latches have a considerable thickness in a direction orthogonal to the door edge to which the latches are secured; such direction is usually critical for the window glass or for the window glass channel path, i.e. the channel path followed by the window glass during its movements between raised and lowered positions. In certain cases, too large sizes of the thickness of the latches may influence the shape and style of the window glass.

Moreover, the above-described configuration is also problematic in cases in which it is required to isolate the electric part of the actuator assembly from the part of the latch subject to damp or water in order to prevent latch malfunctions in case the water penetrates into the latch, e.g. during raining or even in case of submerged vehicle.

Last but not least, due to the integration of the actuator assembly in the same body containing the ratchet and the other mechanical levers, the packaging of the latch has a significant size in the fixation plane; this could create issues to install the latch in different environments and customizations and may require a deep review or a complete redesign of the latch in case of different footprints, i.e. different positions of the fixation points in the door edge and different shapes and/or lengths of the opening in the door edge for receiving the striker, typically known as "fishmouth".

SUMMARY

This section provides a general summary of the disclosure and is not a comprehensive disclosure of its full scope or all of its aspects, objectives, advantages and/or features.

It is an object of the present invention to provide an electrical vehicle latch designed to provide a straightforward, low-cost solution to the above drawbacks of known latches.

According to the present disclosure, an electric latch for a motor vehicle comprises:

- a support assembly;
- a releasable closure mechanism carried by the support assembly and adapted to releasably engage a striker;
- an electrically-operated actuator assembly carried by the support assembly and which can be selectively activated to release the closure mechanism from the striker or to lock the closure mechanism in a condition of engagement with the striker; and
- an electrical control unit comprising a printed circuit board for controlling operation of the actuator assembly;

wherein the closure mechanism comprises:

- a ratchet movable between a release position, wherein the ratchet is positioned to receive or release the striker, and at least one lock position, wherein the ratchet is positioned to retain the striker, and a releasable locking mechanism cooperating with the ratchet to prevent disengagement between the striker and the ratchet;
- wherein the support assembly comprises a first support body carrying at least said ratchet in a position parallel to a first plane (P1), and a second support body carrying at least the printed circuit board in a position parallel to a second place (P2) which is transverse to the first plane (P1).

Further areas of applicability will become apparent from the description provided herein. The description and specific example in this summary are intended for purposes of illustration only and are not intended to limit the scope of the present disclosure.

DRAWINGS

A preferred, non-limiting embodiment of the present invention will be described by way of example with reference to the accompanying drawings, in which.

DETAILED DESCRIPTION

Figure 1:
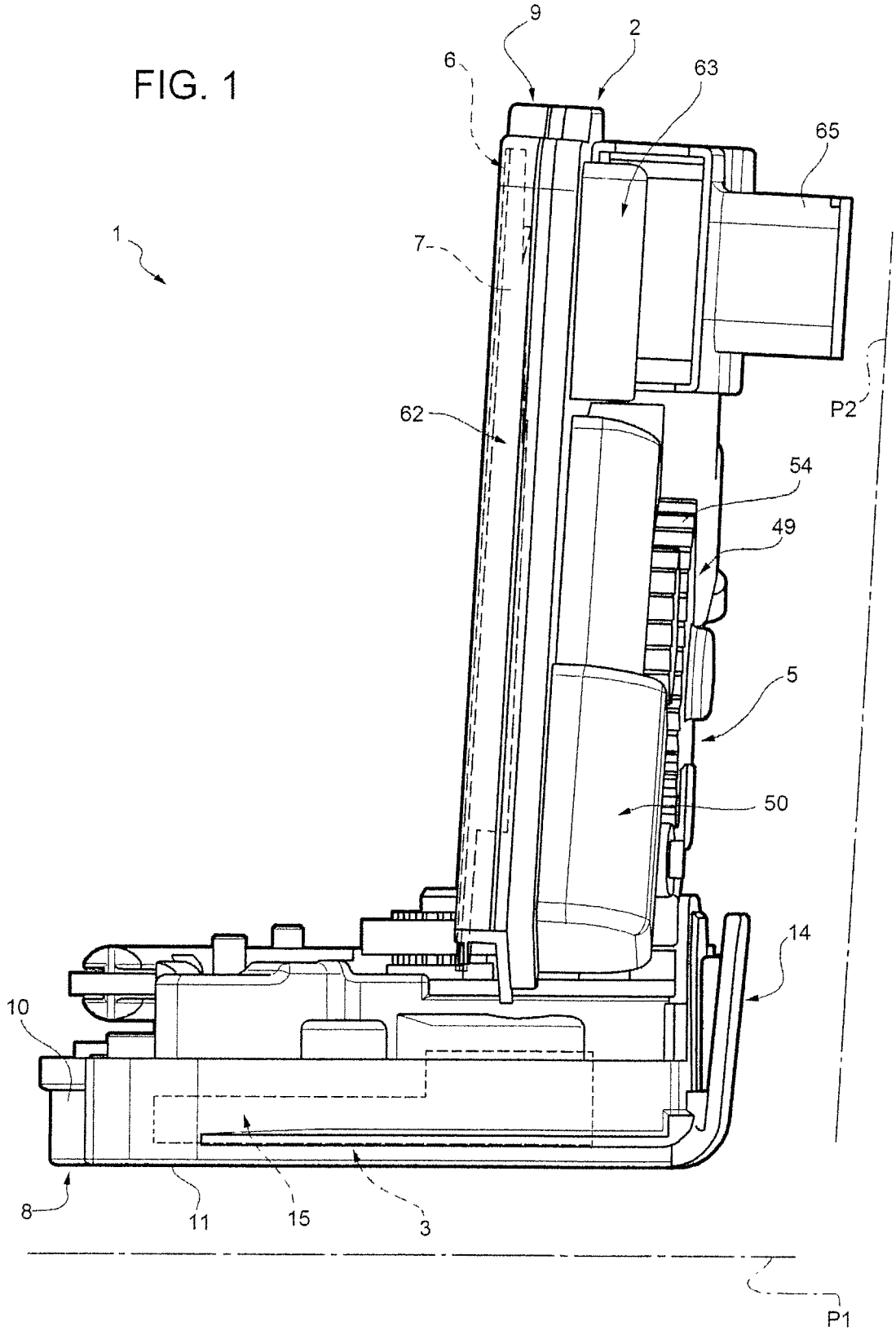
FIG. 1 is a top plan view of an electrical vehicle latch in accordance with the present invention and in a position of use on the vehicle.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Number 1 in FIGS. 1 to 3 and 8 indicates as a whole an electrical latch for a vehicle door (not shown). Latch 1 basically comprises: a support assembly 2 fixed, in know manner and in the position of FIGS. 1 to 3, to the vehicle door; a releasable closure mechanism 3 carried by support assembly 2 and adapted to releasably engage a striker 4 (only partially shown in FIG. 2) integral with a fixed doorpost (not shown); an electrically-operated actuator assembly 5 carried by support assembly 2 and which can be selectively activated to release closure mechanism 3 from striker 4 or to lock closure mechanism 3 in a condition of engagement with the striker 4; and an electronic control unit 6 (FIG. 8) comprising a printed circuit board 7 for controlling operation of actuator assembly 5.

In an alternative embodiment not shown, striker 4 may be fixed to the vehicle door, and support assembly 2, together with latch 1, may be fixed to the doorpost.

With reference to FIGS. 1, 2, 3 and 8, support assembly 2 comprises two support bodies 8, 9, each having a reduced thickness with respect to the other sizes. Bodies 8, 9 are arranged transversally, or substantially perpendicular, to one another, so as to define a L-shaped configuration of support assembly 2 when viewed along a plane perpendicular to both the bodies 8, 9 (see FIG. 1).

In particular, body 8 is substantially plate-shaped and carries closure mechanism 3, whilst body 9 is a fluid-tight casing internally housing, in a fluid-tight manner, electronic control unit 6 and part of actuator assembly 5, and externally carrying the rest of the actuator assembly 5.

Plate-shaped body 8 extends parallel to a first plane P1 and body 9 carries printed circuit board 7 in a position parallel to a second plane P2, transversal to plane P1; in particular, planes P1 and P2 are substantially orthogonal and, in the example shown, form an angle slightly exceeding 90° (see FIG. 1).

Body 8 comprises a structural plate 10 parallel to plane P1 and delimited by opposite faces 10*a*, 10*b*, one of which (10*a*) facing towards body 9 and the other one (10*b*) externally covered by a thin plate-shaped front cover 11.

More specifically, plate 10 has a peripheral edge 12 protruding from face 10*b* and which defines an abutment surface cooperating with a contour portion of cover 11. In practice, cover 11 is secured to peripheral edge 12 and extends in use parallel to face 10*b* of plate 10; cover 11, face 10*b* and protruding peripheral edge 12 delimit a cavity 13, in which some components of closure mechanism 3 are housed, as it will be explained in greater detail later on.

Figure 2:
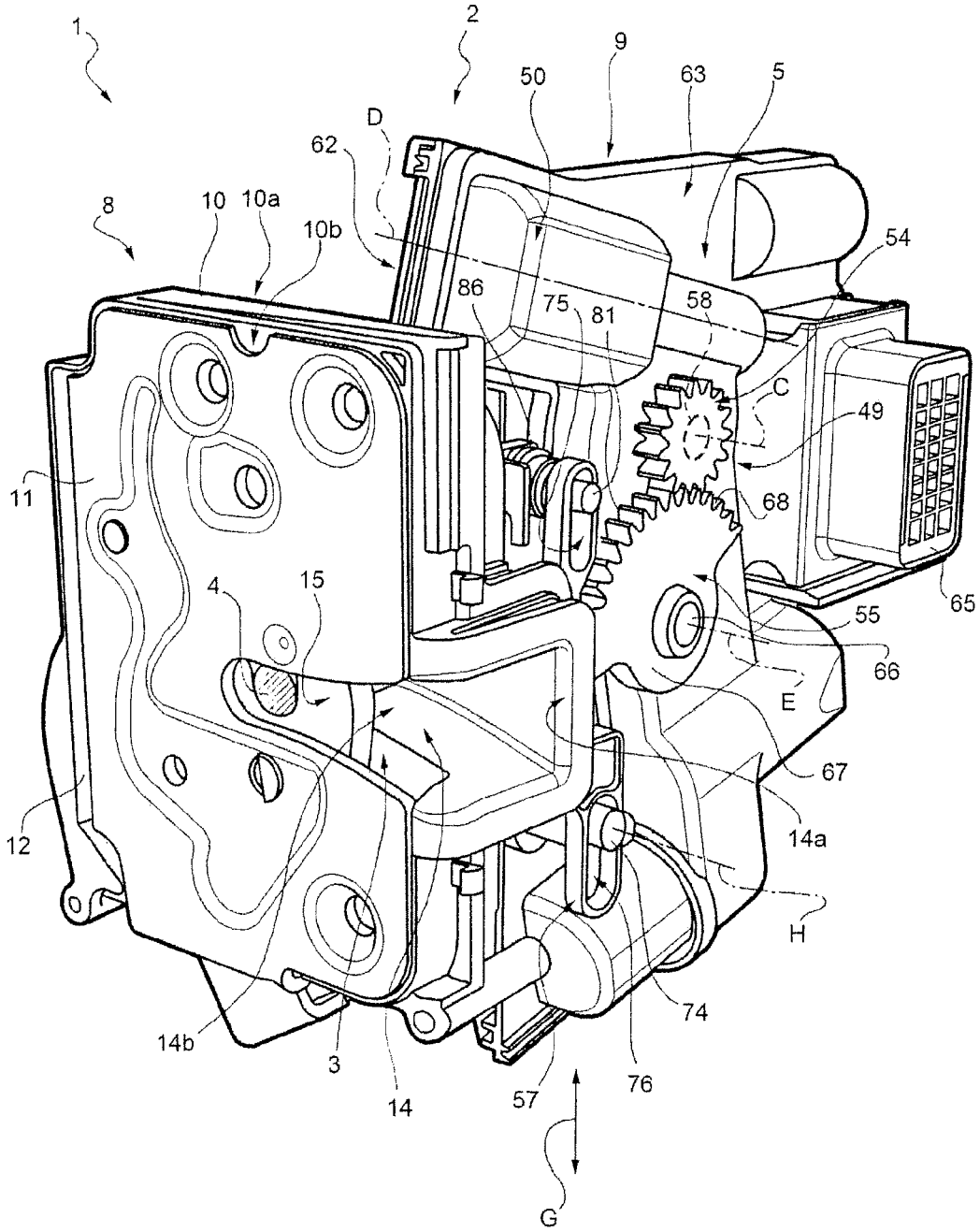
FIG. 2 is a front perspective view of the FIG. 1 latch during an initial stage of an opening manoeuvre.
Figure 3:
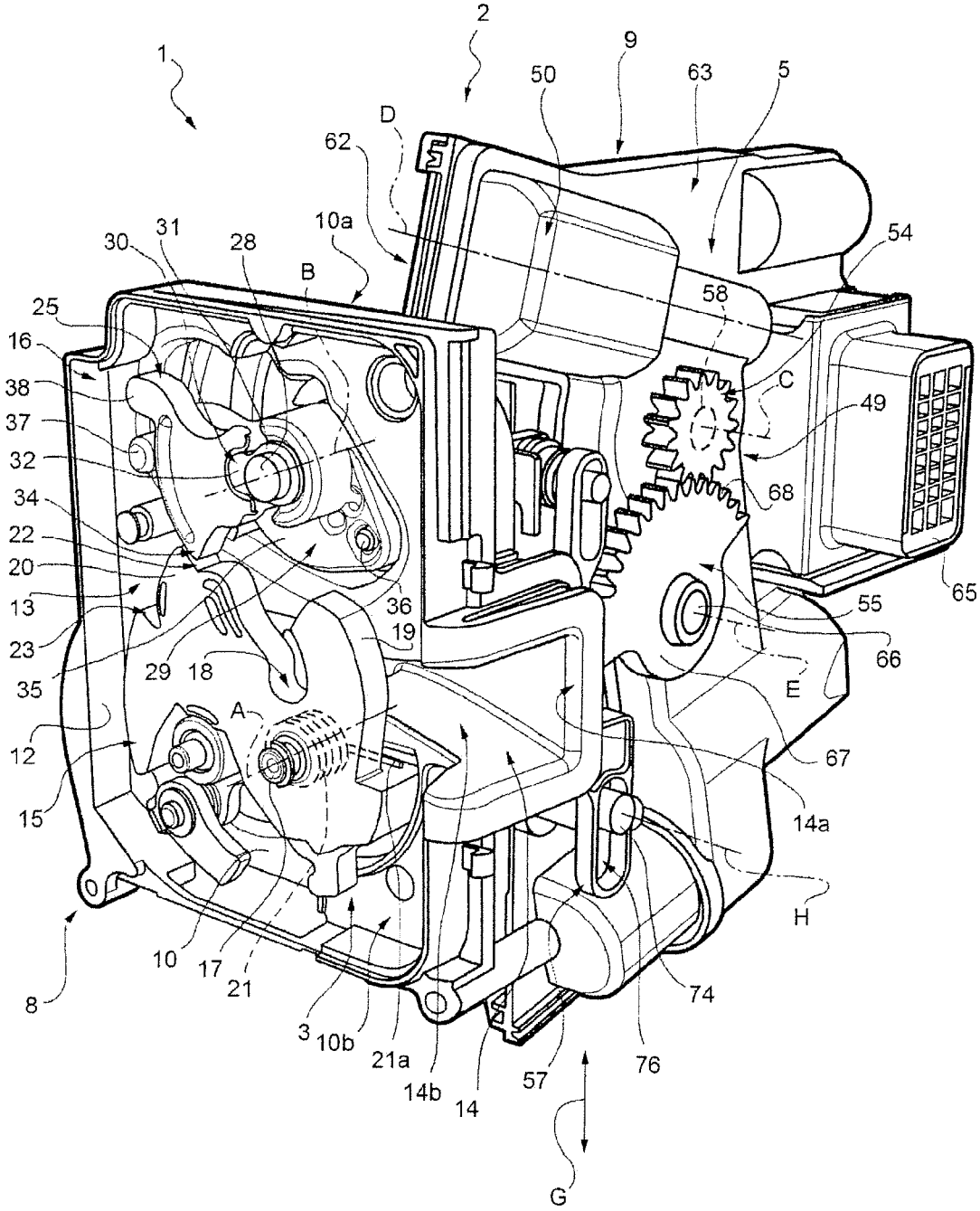
FIG. 3 is the same perspective view of the latch as in FIG. 2 with a front cover removed for clarity.
Figure 8:
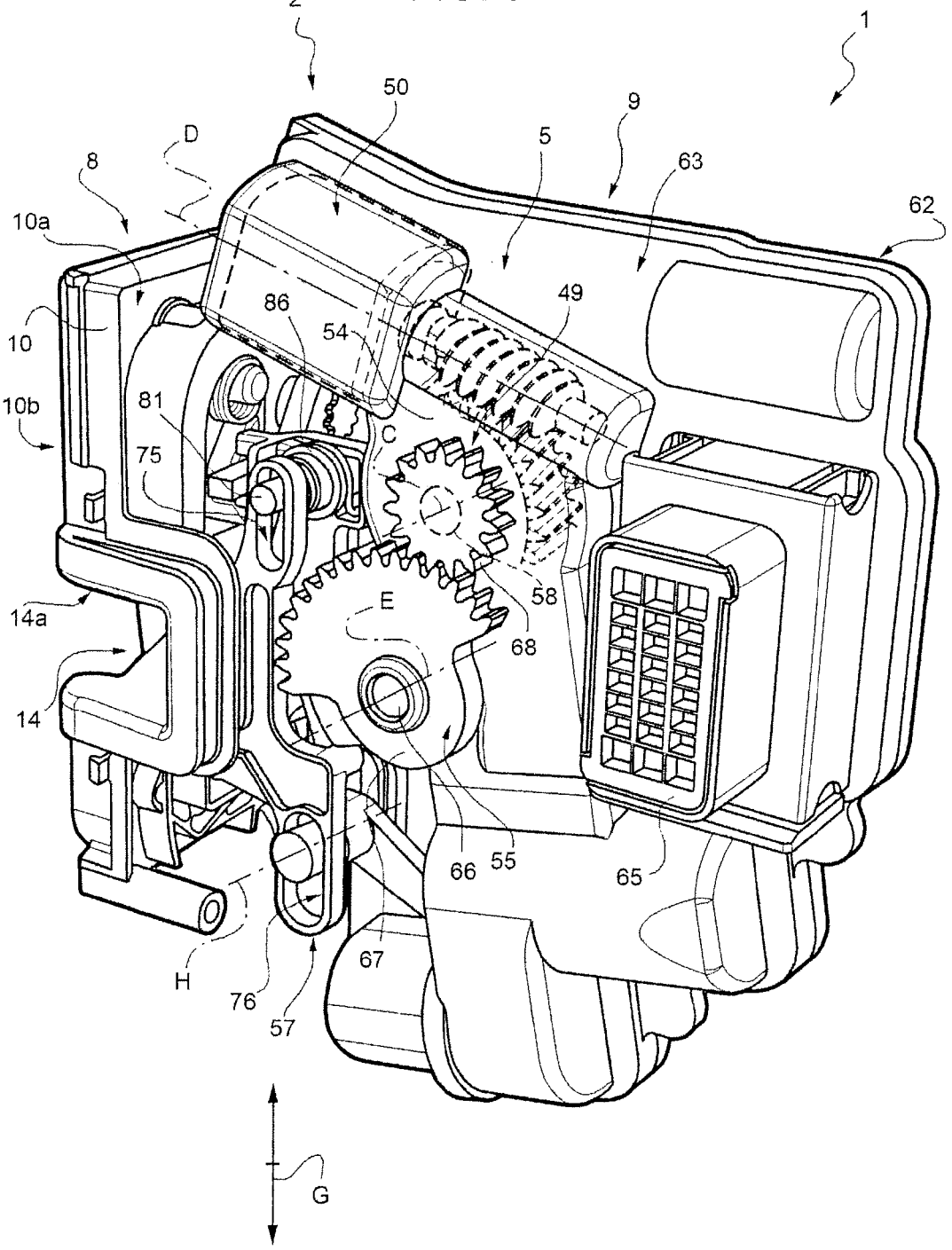
FIG. 8 is a side perspective view of the latch of FIGS. 2 and 3.

As visible in FIGS. 2, 3 and 8, body 8 defines a lateral seat 14 extending along plate 10 and cover 11, delimited by a C-shaped edge and adapted to receive striker 4 when closing the door.

More specifically, seat 14 comprises an inlet opening 14*a* extending through the peripheral contour of plate 10, and a receiving portion 14*b* extending along plate 10 and cover 11 and closed on the opposite side to the inlet opening 14*a*.

In the example shown, seat 14 is arranged substantially on an intermediate portion of body 8.

With reference to FIGS. 1 to 7, closure mechanism 3 basically comprises a ratchet 15 superimposed on seat 14 for receiving striker 4, and a double-pawl releasable locking mechanism 16 cooperating with ratchet 15 to prevent disengagement between the striker 4 and the ratchet 15.

As shown in FIGS. 2 and 3, ratchet 15 is arranged on face 10*b* of plate 10 so being housed in cavity 13 of body 8; ratchet 15 is hinged about a fixed pin 17 extending orthogonally through plate 10, protruding from both faces 10*a*, 10*b* of the plate 10 and having an axis A orthogonal to plane P1. In particular, ratchet 15 is defined by a contoured plate hinged at an intermediate portion about pin 17 and provided with a peripheral seat 18, which has a C-shaped outline, is bounded laterally by two teeth 19, 20 and is adapted to receive striker 4. Ratchet 15 is carried by plate 10 of body 8 in a position parallel to plane P1 (FIG. 1).

A spring 21 (FIG. 3), wound about pin 17, pushes ratchet 15 in known manner into a release position (not shown), wherein seat 18 faces the same way as seat 14 in body 8, and so permits engagement and release of striker 4. Spring 21 has one end (not visible in the enclosed Figures) cooperating with plate 10, and an opposite end 21*a* cooperating with ratchet 15.

When the door is slammed, ratchet 15 is rotated by striker 4 about axis A to lock or click onto locking mechanism 16, as explained in detail below, in two different positions: a partially locked or first-click position (not shown), and a fully locked or second-click position (FIGS. 2 and 3), in which striker 4 is locked inside seat 18 and prevented from withdrawing by tooth 19 increasingly closing off receiving portion 14*b* of seat 14. In the orientation of FIGS. 2 and 3, the ratchet 15 will rotate clockwise to enter the release position.

In greater detail, in the fully locked position, striker 4 is securely ensconced in seat 18 of ratchet 15 such that the vehicle door is completely closed and door seals (not shown) are compressed. In the partially locked position, striker 4 is loosely secured in seat 18 of ratchet 15 such that the vehicle door is locked but not completely closed against its seals.

As ratchet 15 rotates to click onto locking mechanism 16, the partially locked position is therefore interposed between the release position and the fully locked position.

As visible in FIG. 3, the fully locked and partially locked positions are defined by locking mechanism 16 engaging respective shoulders 22, 23 formed along the peripheral edge of ratchet 15, on the side delimiting tooth 20 on the opposite side to seat 18.

With reference to FIGS. 3 to 7, locking mechanism 16 is arranged in part on face 10*a* of plate 10 and in part on face 10*a* of plate 10. Locking mechanism 16 basically comprises: a primary pawl 25 movable between a ratchet checking position (FIG. 3), wherein the primary pawl 25 is positioned to keep the ratchet 15 in the partially locked position or in the fully locked position, and a ratchet release position (not shown), wherein the primary pawl 25 permits the movement of the ratchet 15 out of the partially locked position or the fully locked position; an auxiliary ratchet 26 operatively connected to primary pawl 25 and movable between an enabling position (FIG. 4), in which the primary pawl 25 is enabled to move to its ratchet checking position, and a disabling position (not shown), in which the auxiliary ratchet 26 positions the primary pawl 25 to its ratchet release position; and a secondary pawl 27 movable between an auxiliary ratchet holding position (not shown), in which the secondary pawl 27 is positioned to hold auxiliary ratchet 26 in its enabling position, and an auxiliary ratchet release position (FIG. 4), in which the secondary pawl 27 is positioned to permit movement of the auxiliary ratchet 26 to its disabling position.

Primary pawl 25, auxiliary ratchet 26 and secondary pawl 27 are all defined by contoured plates substantially extending along planes parallel to ratchet 15 and to plane P1. In particular, primary pawl 25 is arranged on face 10*b* of plate 10 and on one side of ratchet 15 and receiving portion 14*b* of seat 14, whilst auxiliary ratchet 26 and secondary pawl 27 are arranged on face 10*a* of plate 10; in the position in which latch 1 is fixed to the vehicle door (FIGS. 1 to 3), primary pawl 25 is arranged at an upper position than ratchet 15.

As visible in FIGS. 3 to 7, auxiliary ratchet 26 is hinged about a fixed pin 28 extending orthogonally through plate 10, protruding from both faces 10*a*, 10*b* of the plate 10 and having an axis B parallel to axis A.

Primary pawl 25 and auxiliary ratchet 26 are operatively connected through a transmission lever 29, which is arranged on face 10*b* of plate 10 and below the primary pawl 25 and is hinged on the pin 28. In particular, auxiliary ratchet 26 and transmission lever 29 are hinged on the opposite protruding portions of the same pin 28; primary pawl 25 is superimposed on transmission lever 29.

An eccentric element 30, superimposed on transmission lever 29, has a central portion 31, hinged to the portion of pin 28 protruding from face 10*b* of plate 10, and a radial rounded portion 32 coupled in a complementary seat of primary pawl 25 so as to define a sort of hinging axis for the primary pawl 25; in practice, thanks to the connection to eccentric element 30, primary pawl 25 can rotate about axis B to define ratchet checking position and ratchet release position.

Primary pawl 25 defines peripherally a check shoulder 34 extending substantially radially from axis B and adapted to pivot between the ratchet checking position, in which the check shoulder 34 stops the opening urge of the ratchet 15, as shown in FIG. 3, and the ratchet release position, in which the check shoulder 34 does not inhibit rotation of the ratchet 15 to ratchet release position.

In the orientation of FIG. 3, primary pawl 25 will rotate clockwise to move into the ratchet release position.

In particular, check shoulder 34 of primary pawl 25 interacts in use with the shoulders 22, 23 of the ratchet 15 to define the fully locked position and the partially locked position, respectively.

Transmission lever 29 has one peripheral portion 35, which is radially spaced from axis B and is coupled to a stub 36 projecting from auxiliary ratchet 26 in a direction parallel to axis B through an opening (not shown) of plate 10. Transmission lever 29 further comprises an interacting arm 37 angularly spaced from peripheral portion 35 with respect to axis B and adapted to cooperate in use with a protruding arm 38 of primary pawl 25 to move the latter to the ratchet release position.

Primary pawl 25 is biased to the ratchet checking position by a spring, known per se and not shown.

Auxiliary ratchet 26 (FIGS. 4 to 7) has an elongated shape and extends, for the most part, substantially in a radial direction from pin 28; auxiliary ratchet 26 has one end portion 39 hinged to pin and one opposite tooth-shaped end portion 40 cooperating with secondary pawl 27.

Figure 4:
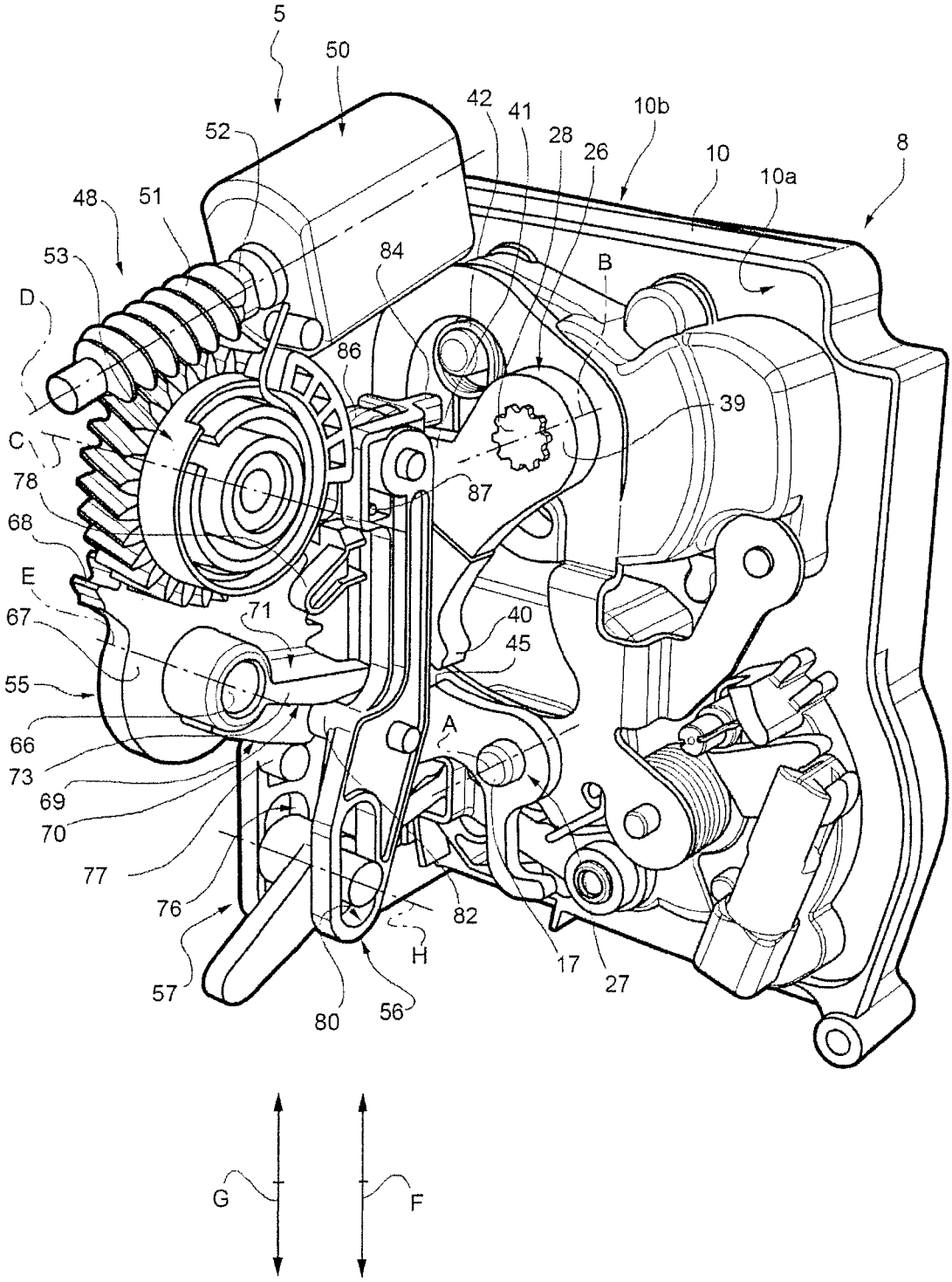
FIG. 4 is a rear perspective view of the latch of FIGS. 2 and 3, with parts removed for clarity.

In particular, auxiliary ratchet 26 can rotate about axis B between the enabling position, in which the auxiliary ratchet 26 allows the primary pawl 25 to reach and maintain the ratchet checking position, and the disabling position, in which the auxiliary ratchet 26, through the transmission lever 29, maintains the primary pawl 25 disengaged from the ratchet 15. In the orientation of FIG. 4, auxiliary ratchet 26 will rotate anticlockwise to enter the disabling position.

Auxiliary ratchet 26 is further provided, at its intermediate portion, with a protruding interacting arm 41, which extends from a peripheral edge of the auxiliary ratchet 26 towards body 9 and is adapted to receive actuating forces from actuator assembly 5, as it will be explained in greater detail later on.

In practice, the intermediate portion of auxiliary ratchet 26 is provided with the stub 36, which extends through plate 10 to engage peripheral portion 35 of transmission lever 29, and the interacting arm 41, which extends transversally with respect to the stub 36 and cooperates with actuator assembly 5.

A spring 42 (only partially shown in FIG. 4), wound about a fixed post extending parallel to pin 28 from face 10*a* of plate 10, biases auxiliary ratchet 26 to the disabling position. Spring 42 has one end (not shown) cooperating with plate 10, and one opposite end (not shown) cooperating with stub 36 of auxiliary ratchet 26.

Figure 6:
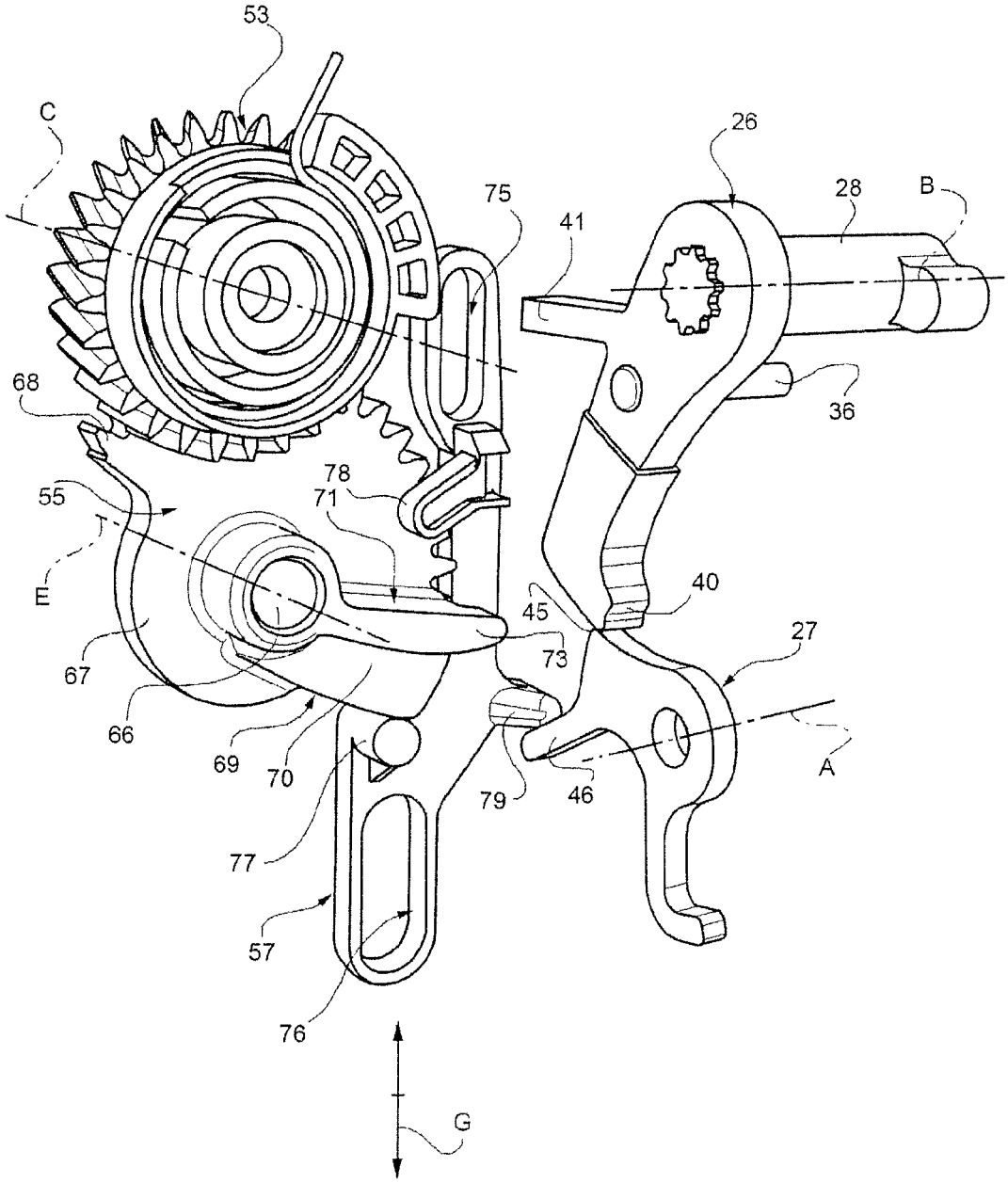
FIG. 6 is the same side perspective view of the latch as in FIG. 5 with some levers removed for clarity.

With reference to FIGS. 4 and 6, secondary pawl 27 is hinged on a portion of pin 28 protruding from face 10*a* of plate 10 and is arranged to cooperate with tooth-shaped end portion 40 of auxiliary ratchet 26.

With reference to the position of use on the vehicle (FIGS. 2 to 4), secondary pawl 27 is arranged in a position lower than auxiliary ratchet 26 and partially facing the end portion 40 thereof.

In particular, secondary pawl 27 defines a check shoulder 45 for interacting with end portion 40 of auxiliary ratchet 26 and comprises an interacting arm 46, angularly spaced from check shoulder 45 about axis A and adapted to receive actuating forces from actuator assembly 5, as it will be explained in greater detail later on.

Secondary pawl 27 rotates about axis A between the auxiliary ratchet holding position (not shown), in which check shoulder 45 interacts with end portion 40 to stop the urge of the auxiliary ratchet 26 towards the disabling position, and the auxiliary ratchet release position (FIGS. 4 and 6), in which check shoulder 45 is detached from end portion 40 to permit movement of the auxiliary ratchet 26 to its disabling position. Secondary pawl 27 is biased towards the auxiliary ratchet holding position in a known manner by a spring (not shown).

With reference to all the enclosed Figures, actuator assembly 5 basically comprises: an electric motor 50; a worm gear 51 coaxially coupled to a rotating member 52 of motor 50; a first gear wheel 53 meshing with the worm gear 51; a second gear wheel 54 angularly integral with gear wheel 53, i.e. rotating together with gear wheel 53 about a common axis C orthogonal to plane P2; a sector gear 55 meshing with gear wheel 54; a first actuating lever 56 driven by sector gear 55 for interacting with arm 41 of auxiliary ratchet 26 so as to move the auxiliary ratchet 26 from the enabling position to the disabling position; and a second actuating lever 57 driven by sector gear 55 for interacting with arm 46 of secondary pawl 27, so as to move the secondary pawl 27 to the auxiliary ratchet release position (reset function), and with actuating lever 56, so as to produce movement of the auxiliary ratchet 26 from the disabling position to the enabling position (release function).

As shown in particular in FIGS. 2, 3, 8 and 9, body 9 internally houses, in a fluid-tight manner, electronic control unit 6, electric motor 50, worm gear 51 and gear wheel 53; the other components of actuator assembly 5, i.e. gear wheel 54, sector gear 55 and actuating levers 56, 57, are all externally carried by body 9. Gear wheels 53 and 54 are both fitted onto a common shaft 58 of axis C, externally protruding, in a fluid-tight manner, from body 9.

In practice, worm gear 51 and gear wheel 53 define a first transmission 48 housed, in a fluid-tight manner, inside body 9 and directly driven by electric motor 50, whilst gear wheel 54 and sector gear 55 define a second transmission 49 functionally interposed between transmission 48 and actuating lever 57 and carried externally by body 9. Transmissions 48 and 49 are operatively coupled by shaft 58, which crosses body 9 in a fluid-tight manner through the interposition of a sealing element, such as a gasket (known per se and not shown).

According to a preferred embodiment of the present invention (see in particular FIG. 9), body 9 has a sandwich structure and defines two distinct chambers 59, 60, one of which (chamber 59) houses, in a fluid-tight manner, control unit 6 and the other one (chamber 60) houses, in a fluid-tight manner, electric motor 50 and transmission 48, i.e. worm gear 51 and gear wheel 53. More specifically, body 9 comprises a central plate 61 and two cover elements 62, 63, arranged on opposite sides of plate 61 and peripherally coupled thereto in a fluid-tight manner to define the opposite chambers 59, 60.

Figure 9:
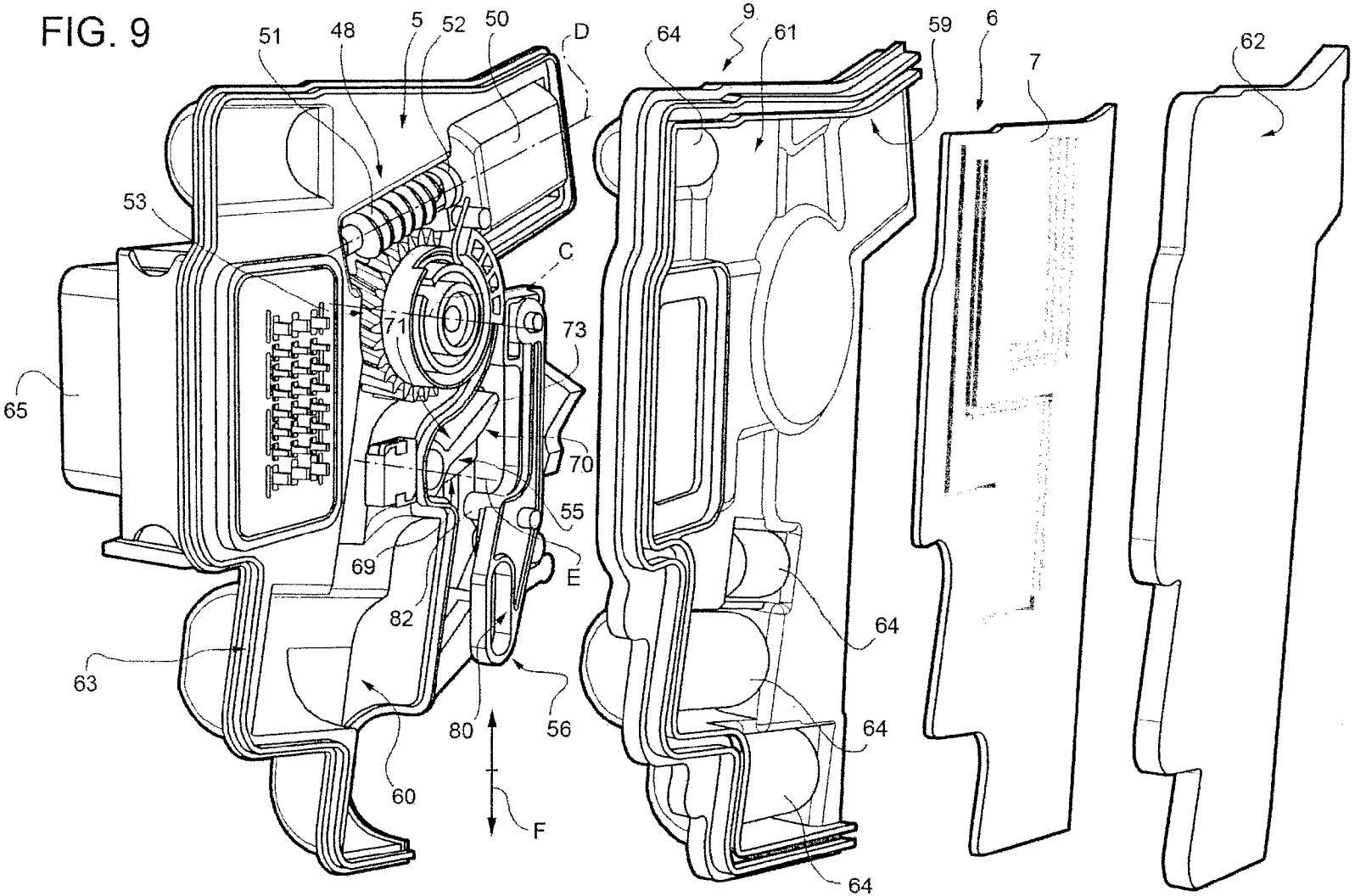
FIG. 9 is an exploded side perspective view of a part of the latch of FIGS. 2, 3 and 8.

As visible in FIGS. 1 and 8, cover element 62 faces towards face 10*a* of plate 10 of body 8 and delimits, with plate 61, chamber 59; as shown in FIG. 9, chamber 59 houses printed circuit board 7 and a plurality of capacitors 64 connected to printed circuit board 7 and making part of control unit 6.

Cover element 63 delimits, with plate 61, chamber 60 and carries externally gear wheel 54, sector gear 55 and actuating levers 56, 57. In particular, shaft 58, carrying gear wheels 53 and 54, crosses cover element 63 in a fluid-tight manner through the interposition of the above-mentioned sealing element, such as a gasket (not visible).

Plate 61 defines a plurality of seats for capacitors 64; the connection of the capacitors 64 to the printed circuit board 7 is made by press-fit connectors, known per se and not shown.

Cover element 62 defines a plurality of seats for electric motor 50, worm gear 51 and gear wheel 53, which are closed on the opposite side by plate 61. Cover element 62 also houses an electric connector 65 for connecting control unit 6 to the electric plant of the vehicle.

With reference to FIGS. 2, 3, 4, 8 and 9, electric motor 50 is housed in the portion of cover element 62 defining the upper part of body 9 in the use position; gear wheels 53, 54, sector gear 55 and actuating levers 56, 57 are all arranged inferiorly with respect to electric motor 50.

Moreover, as visible in FIGS. 1 to 8, gear wheels 53, 54, sector gear 55 and actuating levers 56, 57 lye on planes, which are substantially parallel to plane P2; in particular, gear wheel 54 and sector gear 55 lye on a common plane, whilst gear wheel 53 and actuating levers 56, 57 lye on respective distinct planes parallel to one another and to plane P2.

Electric motor 50 and worm gear 51 have an axis D parallel to plane P2, transversal to plane P1 (see in particular FIG. 1) and orthogonal to axis C. Electric motor 50 and worm gear 51 are rotated in opposite directions to perform release function and reset function respectively.

Gear wheels 53 and 54 are mounted for rotation about axis C and receive actuation forces from worm gear 51; in greater detail, gear wheel 53 is driven by worm gear 51 and is angularly coupled to gear wheel 54 by means of shaft 58.

Sector gear 55 (FIGS. 2 to 8) is mounted for rotation about a fixed pin 66 having an axis E parallel to axis C and spaced therefrom; sector gear 55 meshes with gear wheel 54 so as to receive driving forces therefrom.

Figure 5:
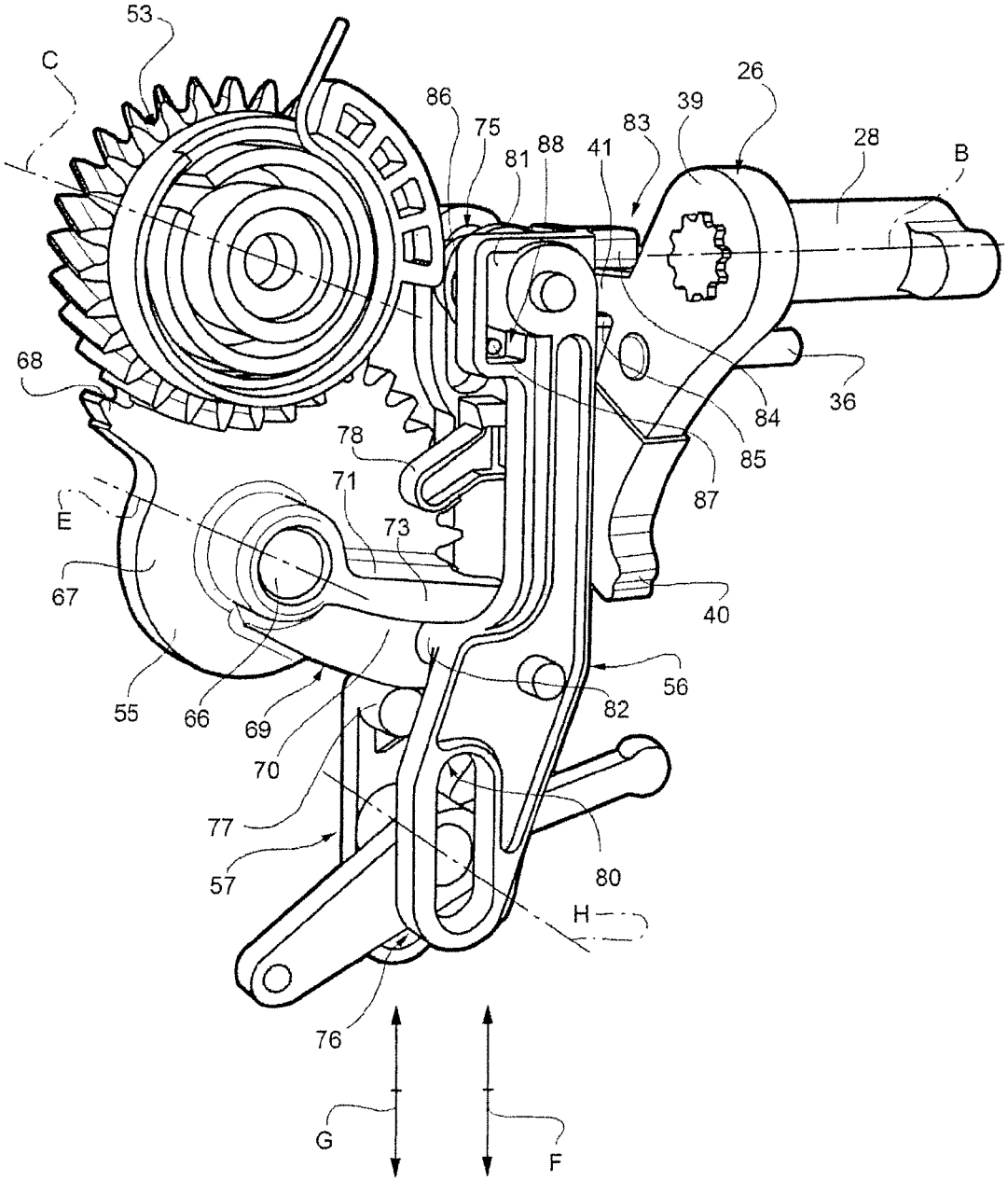
FIG. 5 is a larger-scale side perspective view of the latch of FIG. 4, with parts removed for clarity.

As visible in FIGS. 4 to 6, sector gear 55 comprises a disk 67 having, along a portion of its outline, a plurality of teeth 68 meshing with corresponding teeth of gear wheel 54.

Sector gear 55 further comprises three cam surfaces 69, 70, 71 for interacting with actuating levers 56, 57, as it will be explained in detail later on.

Cam surface 69 is defined by a protruding edge of disk 67 and is adapted to cooperate with actuating lever 57 to move the latter along a release stroke, during which the actuating lever 57 produces rotation of secondary pawl 27 from the auxiliary ratchet holding position to the auxiliary ratchet release position.

Cam surfaces 70 and 71 are provided on the opposite sides of a rib 73 protruding frontally from disk 67 and extending substantially along a radial direction with respect to axis E.

Cam surface 70 acts in the same direction as cam surface 69 and is adapted to cooperate with actuating lever 56 to move the latter along a release stroke, during which the actuating lever 56 produces rotation of auxiliary ratchet 26 from the enabling position to the disabling position.

Cam surface 71 acts in a direction opposite to direction of action of cam surfaces 69, 70 and is adapted to cooperate with actuating lever 57 to move the latter along a reset stroke, during which the actuating lever 57 produces, through actuating lever 56, rotation of auxiliary ratchet 26 from the disabling position to the enabling position.

In particular, sector gear 55 is rotated by electric motor 50, worm gear 51 and gear wheels 53, 54 about axis E in a first direction (clockwise in FIGS. 4 to 6) to produce release of the latch 1, and in a second direction (anticlockwise in FIGS. 4 to 6), opposite to the first direction, to obtain reset of auxiliary ratchet 26 to the enabling position, in which the auxiliary ratchet 26 allows closure of the latch 1 by slamming the door. In the following description, the rotation of sector gear 55 in the first direction will be referred to as "release rotation" and the opposite rotation of the sector gear 55 in the second direction will be referred to as "reset rotation".

By considering the release rotation of sector gear 55 about axis E, cam surface 69 is arranged downstream of cam surface 70, which is in turn arranged downstream of cam surface 71.

Figure 7:
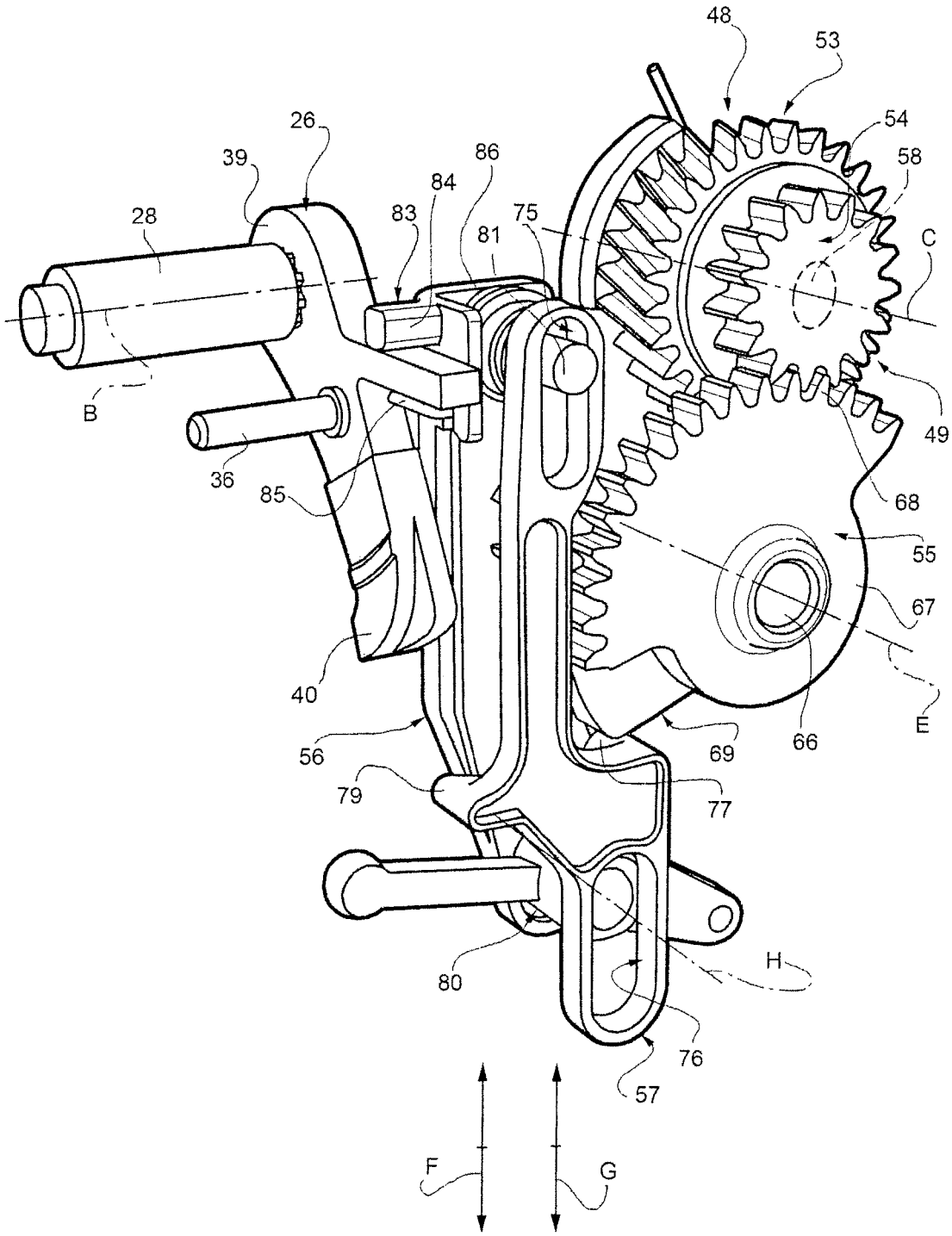
FIG. 7 is an opposite side perspective view of the latch of FIG. 5, with parts removed for clarity.

With particular reference to FIGS. 5 to 7, actuating levers 56, 57 have elongated shapes and extend along respective longitudinal directions F, G parallel to one another and to both planes P1 and P2. More specifically, actuating lever 57 is arranged adjacent to sector gear 55, whilst actuating lever is placed on the opposite side of actuating lever 57 with respect to sector gear 55. Actuating levers 56, 57 are carried by body 9 in a displaceable manner along respective longitudinal directions F, G. Release and reset strokes of actuating levers 56, 57 are defined by opposite movements of such levers 56, 57 along the respective longitudinal directions F, G.

In the example shown, the release stroke is defined by movements of actuating levers 56, 57 away from electric motor 50, whilst the reset stroke is defined by movements of actuating levers 56, 57 towards electric motor 50.

Actuating lever 57 has, at its opposite end portions, respective through slots 75, 76 extending along direction G and comprises, at its intermediate portion, a first protrusion 77, adapted to receive actuating forces from cam surface 69 during the release rotation of sector gear 55, and a second protrusion 78 adapted to cooperate with cam surface 71 during the reset rotation of sector gear 55. In the example shown, slot 75 is adjacent to electric motor 50 and protrusion 78 is adjacent to slot 75; protrusion 77 is instead adjacent to slot 76.

Actuating lever 57 further comprises, at its intermediate portion, a protruding arm 79 adapted to cooperate with arm 46 of secondary pawl 27 to move the secondary pawl 27 from the auxiliary ratchet holding position to the auxiliary ratchet release position.

It should be noted that slot 76 is longer than slot 75 along direction G for the reason that will be clarified later on.

Actuating lever 56 has, at one end portion, a through slot 80 facing slot 76 of actuating lever 57 and extending along direction F; slots 76 and 78 are both engaged, with play along respective directions F, G, by a fixed post 74, which is carried by body 9 and extends along an axis H parallel to axes C, E; actuating levers 56 and 57 can slide with respect to post 74 along the respective directions F, G through the guiding action performed by slots 76 and 78.

Actuating lever 56 has, at its opposite end portion, a protruding stub 81 engaging slot 75 of actuating lever 57 with play along direction G. Stub 81 and the edge of slot 75 are slidingly coupled to one another along the respective directions F, G.

Actuating lever 56 further comprises an intermediate protrusion 82 adapted to receive actuating forces from cam surface 70 during the release rotation of sector gear 55.

Actuating lever 56 finally comprises a fork portion 83 arranged adjacent to stub 81, protruding towards face 10*a* of plate 10 and engaged by arm 41 of auxiliary ratchet 26 to move the latter from the enabling position to the disabling position and vice versa.

According to a preferred embodiment of the present invention, fork portion 83 is defined by a rigid post 84 protruding from actuating lever 56 and by a first tang 85 of a spring 86 wound about stub 81 and having a second tang 87 engaging an opening 88 formed in the end portion of actuating lever 56 carrying the stub 81.

By considering the direction of rotation of auxiliary ratchet 26 about axis B from the enabling position to the disabling position, tang 85 is arranged downstream of rigid post 84.

In practice, auxiliary ratchet 26 is pushed towards the disabling position by rigid post 84 of actuating lever 56 and is displaced to the enabling position by tang 85 of spring 86 interposed between the actuating lever 56 and the auxiliary ratchet 26. In this way, when auxiliary ratchet 26 has reached the enabling position, a possible undesired stop of electric motor 50 in an overrun position at the end of the reset rotation imparted to sector gear 55 only causes a tensioning of spring 86, without any undesired stress on the electric motor 50.

Abutment along direction G of opposite edge end portions of slot 76 against fixed post 74 defines a release position and a reset position of actuating lever 57.

In a completely analogous manner, abutment along direction F of opposite edge end portions of slot 80 against fixed post 74 defines a release position and a reset position of actuating lever 56.

Preferably, actuating lever 57 is biased by a spring, known per se and not shown, towards an intermediate position between release and reset position; this intermediate position is defined by abutment between stub 81 and the edge end of slot 75 arranged upstream of the stub 81 along the reset stroke.

During a first part of the release rotation of sector gear 55, imparted by a rotation of electric motor 50 in the direction to perform the release function of the latch 1, cam surface 69 acts on protrusion 77, and slot 75 and stub 81 allow an independent displacement of actuating lever 57 along direction G with respect to actuating lever 56 and towards the release position; the subsequent interaction of cam surface 70 with protrusion produces a corresponding displacement of actuating lever 56 in the same direction as actuating lever 57 and towards the release position.

During the reset rotation of sector gear 55, imparted by a rotation of electric motor 50 in the direction to perform the reset function of the latch 1, cam surface 71 acts on protrusion 78, and the edge of slot 75 in contact with stub 81 in the intermediate position of actuating lever 57 pushes the stub 81 so as to produce the same displacement of both actuating levers 56, 57 along the respective directions F, G towards the reset positions.

In practice, slot 75 and stub 81 define coupling means 85 for connecting actuating levers 56, 57 and which are active during a reset rotation of sector gear 55 to move said levers 56, 57 together and to produce displacement of auxiliary ratchet 26 from the disabling position to the enabling position through the action of fork portion 83.

In use, starting from a closed condition, the latch 1 is released by activating electric motor 50 so as to obtain a rotation of gear wheels 53, 54 about axis C in a clockwise direction with reference to FIGS. 2, 3, 7, 8 and in an anticlockwise direction with reference to FIGS. 4, 5, 6, 9. This movement of gear wheels 53, 54 produces the release rotation of sector gear 55 about axis E (anticlockwise in FIGS. 2, 3, 7, 8 and clockwise in FIGS. 4, 5, 6, 9).

During a first part of the release rotation of sector gear 55, cam surface 69 interacts with protrusion 77 of actuating lever 57 so causing the release stroke of the actuating lever 57 along direction G; in practice, actuating lever 57 moves towards its release position, so causing a rotation of secondary pawl 27 about axis A from the auxiliary ratchet holding position to the auxiliary ratchet release position; in particular, the rotation of secondary pawl 27 towards the auxiliary ratchet release position is obtained through the interaction of arm 79 of actuating lever 57 with arm 46 of the secondary pawl 27 (FIG. 6).

Under the thrust of spring 42, auxiliary ratchet 26 is therefore free to rotate about axis B into its disabling position. Should the spring action be insufficient, the interaction of cam surface 70 of rib 73 of sector gear 55 on protrusion 82 of actuating lever 56 produces the release stroke of the actuating lever 56 along direction F with the consequent pushing action of rigid post 84 of fork portion 83 on arm 41 of auxiliary ratchet 26.

At the end of its release stroke, actuating lever 57 is biased by its spring to its intermediate position, in which the edge end of slot 75, arranged downstream of stub 81 of actuating lever 56 along the release stroke (lower edge end in FIGS. 2, 3, 5, 7 and 8), abuts against the stub 81.

Therefore, the result of the movement imparted by the activation of electric motor 50 is a rotation of secondary pawl 27 into the auxiliary ratchet release position and a consequent rotation of auxiliary ratchet 26 into the disabling position. This latter rotation produces a corresponding rotation of transmission lever 29, which, through the interaction of its arm 37 with arm of primary pawl 25, produces the rotation of the primary pawl 25 about axis B so as to free ratchet 15.

In this condition, the ratchet 15 can rotate about axis A into the release position under the thrust of spring 21 so freeing striker 4 and allowing opening of the door.

Immediately after the release of the latch 1, electric motor 50 is again activated in the opposite direction so as to produce a rotation of gear wheels 53, about axis C in an anticlockwise direction with reference to FIGS. 2, 3, 7, 8 and in a clockwise direction with reference to FIGS. 4, 5, 6, 9. This movement of gear wheels 53, 54 produces the reset rotation of sector gear 55 about axis E (clockwise in FIGS. 2, 3, 7, 8 and anticlockwise in FIGS. 4, 5, 6, 9).

During the release rotation of sector gear 55, cam surface 71 of rib 73 interacts with protrusion 78 of actuating lever 57 so causing the reset stroke of the actuating lever 57 along direction G; in practice, actuating lever 57 moves towards its reset position. Due to the cooperation of the lower edge end of slot 75 with stub 81, actuating levers 56, 57 are moved together in their respective directions F, G along their reset strokes.

This movement produces a rotation of auxiliary ratchet 26 about axis B into its enabling position; therefore, the secondary pawl 27 can return to its auxiliary ratchet holding position under the thrust of its spring; in practice, auxiliary ratchet 26 is retained in its enabling position by engagement of its end portion 40 with shoulder 45 of secondary pawl 27.

The reset rotation of auxiliary ratchet 26 is obtained through the pushing action of tang 85 of spring 86 of actuating lever 56 on arm 41 of auxiliary ratchet 26.

When the door is slammed an impact of striker 4 is produced on tooth 20 of ratchet 15 with a consequent anticlockwise rotation of the ratchet 15 about axis A in opposition to spring 21. As shoulder 22 of ratchet 15 is pushed past primary pawl 25, the latter clicks further towards the ratchet 15 with its free end positioned in front of the shoulder 22; ratchet 15 is thus prevented from being sprung back by spring 21 into the release position by shoulder 22 resting against the free end of the primary pawl 25, and so remains locked in the fully locked position, in which tooth 19 closes off seat 14 of support body 8 to prevent withdrawal of striker 4 from opening 12 (FIGS. 2 and 3).

The advantages of electrical latch 1 according to the present invention will be clear from the foregoing description.

In particular, thanks to the fact that printed circuit board 7 is carried by support assembly 2 in a position substantially orthogonal to the plane of ratchet 15, the thickness of latch 1, in the direction orthogonal to the door edge to which the latch 1 is secured, is appreciably reduced with respect to the corresponding thickness of known latches. This configuration therefore has no impact on the shape and design of the window glass and the window glass channel.

Moreover, the configuration according to the present invention permits to separate the electrical part of the latch 1 from the purely mechanical part (closure mechanism 3). In this way, the electronic control unit 6 and the electronic motor 50 can be housed inside a fluid-tight support body 9 completely isolated from the rest of the latch 1.

Preferably, a mechanical part of actuator assembly 5 is also housed inside the support body, so being protected by damp and water, which may transform into ice in case of low temperatures and may cause functioning problems.

Last but not least, the mechanical part of the latch 1 is smaller than that of known latches and consists of a very few components that can be easily installed in several different environments and easily customized when required.

Clearly, changes may be made to the vehicle latch 1 as described and illustrated herein without, however, departing from the scope of protection as defined in the accompanying claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electrical vehicle latch comprising:

a support assembly;

a releasable closure mechanism carried by said support assembly and adapted to releasably engage a striker;

an electrically-operated actuator assembly carried by said support assembly and which can be selectively activated to release said closure mechanism from said striker or to lock said closure mechanism in a condition of engagement with the striker; and an electrical control unit comprising a printed circuit board for controlling operation of said actuator assembly;

wherein said closure mechanism comprises:

a ratchet movable between a release position, wherein the ratchet is positioned to receive or release said striker, and at least one lock position, wherein the ratchet is positioned to retain said striker; and a releasable locking mechanism cooperating with said ratchet to prevent disengagement between the striker and the ratchet; and wherein said support assembly comprises a first support body carrying at least said ratchet in a position parallel to a first plane; and a second support body carrying at least said printed circuit board in a position parallel to a second plane transverse to said first plane; and wherein said locking mechanism further comprises:

a primary pawl movable between a ratchet checking position, wherein the primary pawl is positioned to keep said ratchet in the lock position, and a ratchet release position, wherein the primary pawl permits the movement of said ratchet out of said lock position;

an auxiliary ratchet operatively connected to said primary pawl and movable between an enabling position, in which the primary pawl is enabled to move to its ratchet checking position, and a disabling position, in which the auxiliary ratchet positions the primary pawl to its ratchet release position; and a secondary pawl movable between an auxiliary ratchet holding position, in which the secondary pawl is positioned to hold said auxiliary ratchet in its enabling position, and an auxiliary ratchet release position, in which the secondary pawl is positioned to permit movement of said auxiliary ratchet to its disabling position.

2. The latch as claimed in claim 1, wherein each of said first and second support body has a reduced thickness with respect to the other sizes, and wherein said first and second body are arranged transversally to one another so as to define a L-shaped configuration of said support assembly.

3. The latch as claimed in claim 1, wherein said second support body is a fluid-tight casing internally housing at least said printed circuit board.

4. The latch as claimed in claim 1, wherein said closure mechanism is carried by said first support body and said actuator assembly is carried by said second support body.

5. The latch as claimed in claim 1, wherein said actuator assembly comprises an electric motor internally housed, in a fluid-tight manner, in said second support body.

6. The latch as claimed in claim 5, wherein said actuator assembly further comprises:

lever actuating means interacting with said closure mechanism; and transmission means for transmitting motion from said electric motor to said lever actuating means.

7. The latch as claimed in claim 6, wherein said transmission means comprises a first transmission, directly driven by said electric motor, and a second transmission functionally interposed between said first transmission and said lever actuating means.

8. The latch as claimed in claim 7, wherein said first transmission is housed, in a fluid-tight manner, inside said second support body and said second transmission and said lever actuating means are carried externally by said second support body, and wherein said first and second transmission are operatively coupled by a shaft crossing, in a fluid-tight manner, said second support body.

9. The latch as claimed in claim 8, wherein said second support body has a sandwich structure and defines two distinct chambers, a first one of which houses, in a fluid-tight manner, said control unit, and the second one of which houses at least said electric motor.

10. The latch as claimed in claim 9, wherein said second chamber also houses, in a fluid-tight manner, said first transmission.

11. The latch as claimed in claim 7, wherein said first support body comprises a plate having a first face facing towards said second support body and a second face opposite to said first face, and wherein said ratchet and said primary pawl are arranged on said second face of said plate and said auxiliary ratchet and said secondary pawl are arranged on said first face of said plate.

12. The latch as claimed in claim 11, wherein said second transmission and said lever actuating means are carried by said second support body in a position facing towards said auxiliary ratchet and said secondary pawl.

13. The latch as claimed in claim 6, wherein said lever actuating means are configured to interact with said secondary pawl, upon a motion of said electric motor in a first direction, and with said auxiliary ratchet, upon a motion of said electric motor in a second direction opposite to said first direction, and wherein said lever actuating means interact with said auxiliary ratchet through the interposition of a spring element.

14. The latch as claimed in claim 6, wherein said lever actuating means comprise:

a first actuating lever for interacting with said auxiliary ratchet to move the auxiliary ratchet from the enabling position to the disabling position and vice versa;

a second actuating lever driven by said transmission means in a release direction to interact with said secondary pawl to move the secondary pawl to the auxiliary ratchet release position; and coupling means for connecting said first and second actuating lever when said second actuating lever is driven by said transmission means in a reset direction, opposite to said release direction, to move said first and second actuating lever together and to produce displacement of said auxiliary ratchet from the disabling position to the enabling position.

* * * * *